United States Patent [19]

Haberhauer

[11] 4,194,466

[45] Mar. 25, 1980

[54] ELECTROPHOTOGRAPHIC APPARATUS FOR DEVELOPING LATENT ELECTROSTATIC CHARGE IMAGES

[75] Inventor: Helmuth Haberhauer, Taunusstein, Fed. Rep. of Germany

[73] Assignee: Hoechst Aktiengesellschaft, Frankfurt am Main, Fed. Rep. of Germany

[21] Appl. No.: 850,698

[22] Filed: Nov. 11, 1977

[30] Foreign Application Priority Data

Nov. 12, 1976 [DE] Fed. Rep. of Germany ..... 2651646

[51] Int. Cl.[2] ..... G03G 13/09

[52] U.S. Cl. ..... 118/657; 118/651

[58] Field of Search ..... 118/651, 656, 657, 658; 427/18

[56] References Cited

U.S. PATENT DOCUMENTS

| | | | |
|---|---|---|---|
| 3,037,478 | 6/1962 | Lace | 427/18 |
| 3,117,884 | 1/1964 | Greig | 427/18 |
| 3,592,675 | 7/1971 | Cheng | 118/657 |
| 3,754,526 | 8/1973 | Caudill | 118/658 |
| 3,950,089 | 4/1976 | Fraser et al. | 118/651 |
| 3,990,394 | 11/1976 | Katakura | 118/651 |

*Primary Examiner*—Mervin Stein

*Attorney, Agent, or Firm*—Schwartz, Jeffery, Schwaab, Mack, Blumenthal & Koch

[57] ABSTRACT

An apparatus for developing latent electrostatic images in an electrophotographic copier are disclosed, the developer including an image carrier having a conductive backing layer and a photoconductive layer, a magnetic brush developer, a voltage source connected with the magnetic brush developer, and a high-ohmic resistance connecting the backing layer with ground, the voltage source and high-ohmic resistance establishing a potential difference between the magnetic brush developer and the backing layer to prevent a voltage breakdown at the image carrier which may result in undesirable streaking and fogging of an electrostatic copy. The high-ohmic resistance may be adjusted in accordance with the amount of current generated in the developer mixture whereby the flow of current from the developer through the photoconductive layer to the backing layer is impeded to prevent a voltage breakdown. In a first embodiment, the image carrier is a planar printing plate. In a second embodiment, the image carrier is a cylindrical drum having the photoconductive layer arranged on its outer peripheral surface, with charge and transfer coronas arranged adjacent the photoconductive surface, and the embodiment includes a semiconductor unit connected in parallel with the high-ohmic resistance.

8 Claims, 3 Drawing Figures

$I_1-I_2$ [μA]
$I_0, I_1, I_2, I_3$ [μA]
$R = \frac{U_1-U_2}{I_1-I_2}$
$I_3$
$I_0$
$I_1$
$I_2$
A
B
1,5 μA
0,2 μA
DEVELOPER VOLTAGE $U_1$ (VOLTS)
RESISTANCE R (MEGOHMS)
$R_1$
100 MΩ
10
29
30

ELECTROPHOTOGRAPHIC APPARATUS FOR DEVELOPING LATENT ELECTROSTATIC CHARGE IMAGES

BRIEF DESCRIPTION OF THE PRIOR ART

An electrophotographic process for developing electrostatic charge images is disclosed in German Pat. No. 1,024,988, wherein an image carrier bearing a latent electrostatic charge image is supported on a grounded base plate and a charged magnet is arranged above the image carrier, the magnet serving to loosely attract a developer mixture during development. The apparatus further includes a grounded magnetic roller which applies the developer mixture to the image carrier and a conductor plate arranged opposite the magnetic roller over which the image carrier passes. The image carrier may pass in direct contact with the conductor plate or in the immediate vicinity thereof. The conductor plate is connected with a voltage source through a potentiometer so that a bias voltage of the order of 700 volts is applied between the conductor plate and ground.

In the electrophotographic method and apparatus disclosed in the German printed application No. 2,232,513, the apparatus for transferring charge images onto an image receiving material comprises an image carrier, including a metallic back connected directly to ground.

While the prior electrophotographic copiers normally operate quite satisfactorily, the image carriers of the prior art developers are susceptible to voltage breadkowns resulting in streaking or fogging of the copy. The height of the residual voltage of a latent charge image, i.e, the voltage still present in the exposed areas after the image carrier has been charged under a corona and exposed, is determined by different background characteristics and the exposure time of the original. In order to avoid fogging of the copy, it is normally desirable for development to begin at a certain charge which is either equal to or slightly greater than the residual voltage. The residual voltage present on the image carrier is compensated by increasing the voltage applied to the developer. Application of the increased compensating voltage, whose magnitude is determined by the characteristics of the image carrier bearing the latent charge image and the carrier material of the developer mixture, involves the risk that the potential in the developer mixture may be displaced.

If the surface of the image carrier allows a flow of electric current, i.e., if the surface is porous or if it contains damaged or uncoated areas, such as cut edges in the case of printing plates, and if the back of the image carrier is grounded, voltage breakdowns may occur in the developer mixture. These breakdowns occur above a certain voltage level, which is dependent upon the conductivity of the developer mixture. So-called conductive paths are thereby formed in the developer mixture along which voltage breakdowns may occur. If the conductive paths in the developer mixture come into contact with defective areas of the image carrier or with electrically conductive areas on the surface of the image carrier, the developer potential is displaced and flows off to the back of the image carrier. In this manner, annoying and undesirable black streaks and fogging may be produced in the copy.

The formation of a voltage breakdown within the developer mixture depends upon the voltage difference between the developing voltage applied and the voltage at the back of the image carrier and also upon the conductivity of the developer mixture. Differences in the potential within the developer mixture result in high local field strengths between the carrier particles of the developer mixture so that individual discharges may occur. These discharges cause an increase in the voltage differences between the remaining carrier particles of the conductive chain, so that further discharges occur which may result in an avalanche of discharges within a short time and thus lead to a chain reaction. Through the conductive path formed in this manner, the developer voltage flows to the back of the image carrier.

The present invention was developed to provide an improved electrophotographic method and apparatus for developing latent electrostatic charge images wherein the formation of streaks or fogging on the copy due to voltage breakdown between the developer mixture and the carrier for the charge images in defective or uncoated areas of the image carrier surface and at cut edges is avoided.

SUMMARY OF THE INVENTION

The primary object of the present invention is to provide a method and apparatus for developing latent electrostatic charge images comprising an image carrier including a conductive backing layer and an insulating photoconductive layer, a magnetic brush developer, and voltage breakdown protection means including a voltage source connected with the magnetic brush developer and a high-ohmic resistance connecting the backing layer with ground for maintaining the potential of the developer mixture and the charge exchange between the image carrier which is necessary for image development independent of changes in the conductivity of the developer mixture during application of the toner to the charge images.

According to a more specific object of the invention, the high-ohmic resistance of the voltage breakdown protection means comprises a variable resistor adjustable between values of 10 MΩ and 200 MΩ. The ground connection applied to the backing layer of the image carrier by a high-valued resistor impedes the formation of discharge avalanches because the resistor limits the increased current flow which forms in the developer mixture and thus prevents the formation of low-ohmic paths and the resulting displacement of the developer potential. The high-ohmic ground connection of the backing layer of the image carrier must be adjusted so that the charge exchange necessary for image development is not impeded. Depending on the resistance value and the height of the developer voltage applied, the high-ohmic resistor is similar to a control element regulating the conductivity of the developer mixture.

It is a further object of the subject invention that the high-ohmic ground connection of the image carrier increases the voltage at the backing layer of the carrier so that the voltage difference between the applied developer voltage and the voltage at the backing layer of the image carrier is reduced. The lower voltage thus applied to the developer mixture diminishes the avalanche effect and increases the ohmic resistance of the developer mixture, thus reducing the flow of current through the developer mixture and within the developer generator system comprising the developer mixture and the applicator element used for applying the developer mixture to the image carrier, such as a magnetic brush or roller. Thus, the voltage-dependent resistance behavior of the developer mixture, in combination with the ground connection of the backing layer of the image carrier, causes the controlling effect.

It is still another object of the invention to provide an electrostatic copy free from fogging or streaking where the surface of the image carrier contains defective areas.

An additional object of the present invention is to provide an electrophotographic copier in which additional voltages which may interfere with development and are formed at the backing layer of the image carrier as a result of simultaneous exposure, development, or transfer operations are grounded.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
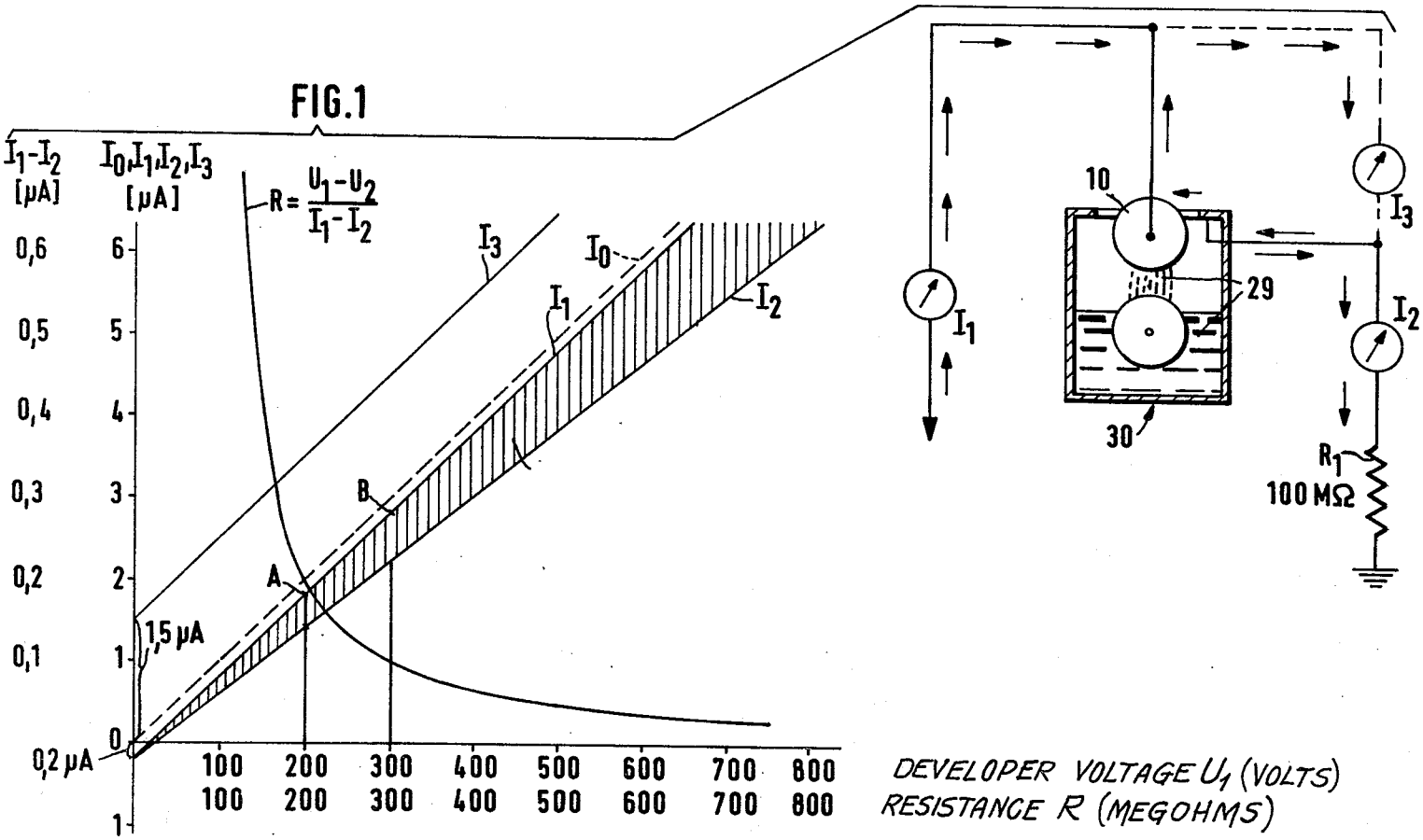
FIG. 1 is a graphical representation of the fundamental current-voltage relations and current-leakage resistance relations in a developer apparatus.

Referring first more particularly to FIG. 1, the current, voltage, and resistance conditions in a fundamental developer apparatus are shown. The behavior of the system comprising the developer mixture and the image carrier for the charge images is not purely ohmic. The developing unit in the form of the magnetic brush 10 and a developer mixture 29, having a toner and carrier material, acts as an additional current and voltage generator 30, as is shown in the fundamental circuit diagram. The carrier material of the developer mixture may be magnetite, ferrite, or similar materials containing iron. The carrier material may be coated or uncoated, and the coating may consist of "Teflon" or an oxide layer. The toner materials for the developer mixture consist of polymers, for example styrene/methacrylate resins with carbon black or epoxy resins with carbon black. With the generator 30 short-circuited and an ohmic leakage resistance $R_1$ of 100 MΩ, the flow of current $I_3$ depends upon two factors: the conductivity of the developer mixture 29 and thus on the voltage applied, and the load on the generator, i.e. the generator load resistance resulting from the system comprising the image carrier and developer mixture. The load resistance is influenced in different ways by the conductivity of the developer mixture 29 depending on the nature of the surface of the image carrier. An additional factor relating to the current and voltage generator 30 is the current produced during application of the toner which becomes more or less noticeable during development. If the surface of the image carrier is not completely insulating, this current is only of minor influence because the galvanic current flow prevails, but if the surface of the image carrier is definitely insulated, its influence must be considered.

In the diagram of FIG. 1, the measured values $I_1$, $I_2$, and $I_3$ and the theoretical value $I_0$ of the currents shown in the fundamental circuit diagram are within the range of from $-1$ μA to 6 μA, depending on the developer voltage $U_1$ which is plotted along the abscissa. $I_1$ is the current in the line supplying the developer voltage $U_1$ to the magnetic brush 10, $I_2$ is the current in the output of the generator 30 if the leakage resistance $R_1$ is 100 MΩ, and $I_3$ is the current when the generator 30 is short-circuited by the low-ohmic ammeter and the leakage resistance $R_1$ has a value of 100 MΩ. It was determined that the value of $I_3$ is higher than the expected theoretical value $I_0$ calculated from the ratio of the developer voltage $U_1$ to the leakage resistance $R_1$.

The displacement of the measured curves of $I_1$ and $I_2$ by 0.2 μA from zero is caused by the generator 30 which, with a leakage resistance $R_1$ of 100 MΩ, generates a current of 0.2 μA which counteracts current $I_1$ of the developer voltage $U_1$. If the generator 30 is short-circuited, a current of 1.5 μA is measured which has the same polarity as current $I_1$ and is added to the theoretical current $I_0$. For example, if $U_1$ has values of 100 volts, 200 volts and 300 volts, respectively, and $R_1 = 100$ MΩ, the current $I_0 = (U_1/R_1) = 1$ μA, 2 μA and 3 μA, respectively, as shown by the dotted line $I_0$. The measured values of the current $I_3$, however, are 2.5 μA, 3.5 μA, 4.5 μA and so on at the voltages indicated, which indicates that the current generated by the generator increases the theoretical current flow $I_0$ uniformly by the 1.5 μA mentioned, so that $I_3 = I_0 + 1.5$ μA.

The difference between the currents $I_1$ and $I_2$ determines the flow of current within the generator 30 which is indicated in the diagram by the shading between the two measured curves $I_1$ and $I_2$ and plotted against the axis of the ordinate.

The product of $I_2$ and $R_1$ indicates the voltage drop $U_2$ at the leakage resistance $R_1$. As already mentioned, FIG. 1 also illustrates the generator current $I_1 - I_2$ as a function of the calculated resistance R of the generator 30. The difference $U_1 - U_2$ between the applied developer voltage $U_1$ and the voltage drop $U_2$ at the leakage resistance $R_1$ yields the voltage drop at the generator 30, for which the following equation applies:

$$R = (U_1 - U_2)/(I_1 - I_2).$$

Substituting values for points A ($U_1 = 200$ volts, $U_2 = 140$ volts, $I_1 - I_2 = 0.4$ μA) and B ($U_1 = 300$ volts, $U_2 = 225$ volts, $I_1 - I_2 = 0.55$ μA) into the above equation, the resistance R at points A and B may be calculated equal to 150 MΩ and 136 MΩ, respectively. In this manner, the resistance curve of the load resistance R of the generator 30 may be plotted.

Figure 2:
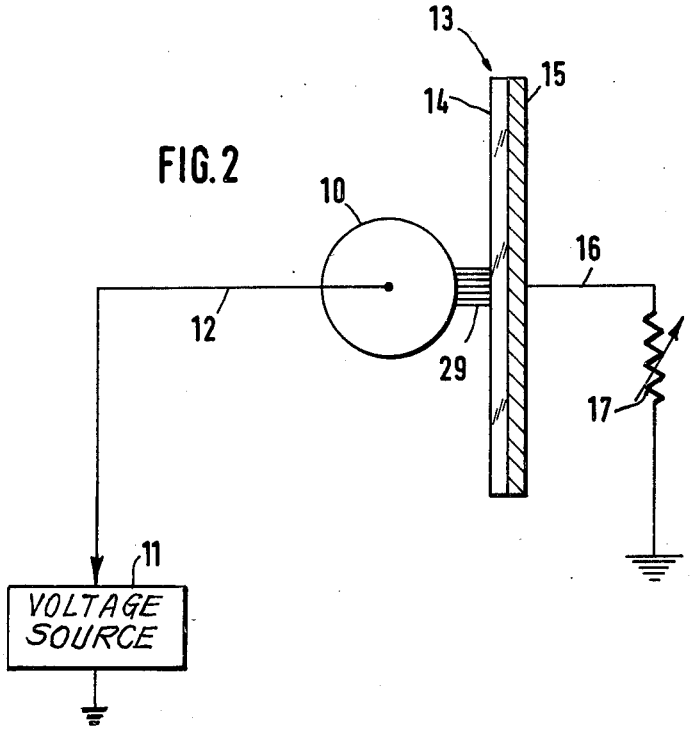
FIG. 2 is a diagrammatic representation of an electrostatic developing apparatus according to the present invention having a linear image carrier.

FIG. 2 is a diagrammatic representation of the apparatus of a first embodiment of the present invention in which the magnetic brush 10 is connected with a voltage source 11 by lead 12 to provide the developer voltage $U_1$. The image carrier 13 has a photoconductive layer 14 as described, for example, in U.S. Pat. No. 3,363,099, with a latent electrostatic charge image thereon, the photoconductive layer being positioned adjacent the magnetic brush 10. The backing layer 15 of the image carrier is grounded through lead 16 and a high-ohmic leakage resistor 17 which preferably has a value between 10 MΩ and 200 MΩ. The potential difference between the magnetic brush 10 and the backing layer 15 lies within the range of from 30 to 100 volts. Application of the developer voltage $U_1$ to the magnetic brush 10 creates an electric field which causes the toner material in the developer mixture to migrate from the magnetic brush onto the photoconductive layer 14 of the image carrier 13.

If the image carrier has a completely insulating surface such as a photoconductive layer, voltage breakdowns within the developer mixture 29, which occur during development of the charge images, can not reliably be avoided by grounding the backing layer 15. This is due to the fact that an insulating photoconductive layer does not allow a galvanic flow of current to the backing layer so that the ohmic leakage resistor can not perform its control action. In the event of a voltage breakdown, the effective developing voltage $U_1$ is applied directly onto the photoconductive layer 14 whereby the danger of puncturing the photoconductive layer is created which would result in a voltage drain at the photoconductor and ultimately in fogging on the copy. However, even though the high-ohmic leakage resistance 17 can not perform its control function, no breakdown of the developing voltage $U_1$ to ground occurs if the photoconductive layer 14 is punctured, and, therefore, a black zone is prevented from being produced on the copy being developed. Hence, it is possible to provide a developed copy free from fogging in spite of a damaged photoconductive layer due to a voltage breakdown.

If the development of the image is performed separately from the other process steps, such as charging of the image carrier 13 or image transfer, the backing layer 15 is preferably grounded solely by the high-ohmic resistor 17.

Figure 3:
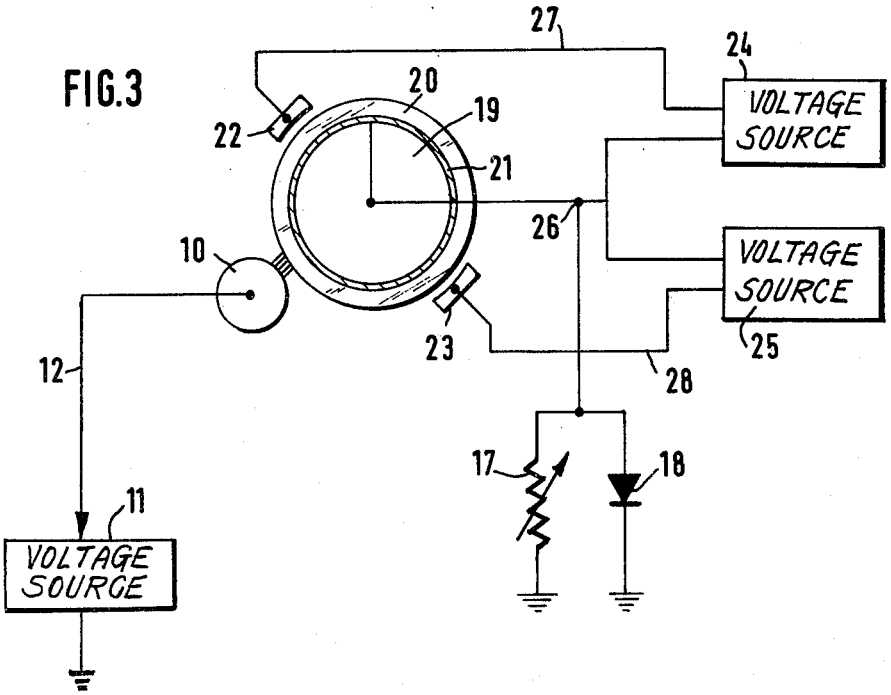
FIG. 3 is a diagrammatic representation of the apparatus of FIG. 2 having a drum-type image carrier.

FIG. 3 is a diagrammatic representation of the apparatus of a second embodiment of the present invention in which several of the aforementioned processing steps are performed simultaneously, each of these steps being possibly accompanied by a considerable flow of current which may influence each other in spite of the high-ohmic ground connection of the backing layer. As shown in FIG. 3, a magnetic brush 10 is again connected with a voltage source 11 through lead 12 to supply the necessary developer voltage of between 100 volts and 800 volts. The voltage source 11 supplies a voltage which is variable from 30 volts to 350 volts. An image carrier in the form of a cylindrical drum 19 has a photoconductive layer 20 arranged on its outer peripheral surface and a conducting backing layer 21. The photoconductive layer on the drum may be a photoconductive double layer of organic materials comprising a charge carrier-producing dyestuff layer of a compound corresponding to the general formula disclosed in U.S. Pat. No. 3,871,882, or it may be a layer containing a condensation product of 3-bromopyrene or 3-chloropyrene with formaldehyde or para-formaldehyde, as described in U.S. Pat. No. 3,842,038, or a polyvinyl carbazole/trinitrofluorenone layer as disclosed in U.S. Pat. No. 3,484,237. Second and third voltage sources 24 and 25, each of which has a voltage range between 3.0 kilovolts and 7.0 kilovolts, are provided having first terminals of one polarity connected with the backing layer 21 at a terminal 26. The second terminal of opposite polarity of the voltage source 24 is connected with a charging corona 22 through lead 27 and the second terminal of opposite polarity of the voltage source 25 is connected with a transfer corona 23 through lead 28. The charge and transfer coronas are arranged adjacent the photoconductive layer 20. Terminal 26 is connected with ground through a leakage resistor 17 connected in parallel with a semiconductor 18. Preferably, the leakage resistor has a value adjustable between 10 MΩ and 200 MΩ and the semiconductor is a diode.

Through application of charges to the photoconductive layer 20 by the charging corona 22 or the transfer corona 23, current is caused to leak from the backing layer 21 of the photoconductive layer 20, creating a voltage drop the magnitude of which depends, i.a., upon the intensity of the charging current and the value of the leakage resistor 17. The voltage created on the backing layer 21 disturbs the uniformity of the virtually simultaneous development of the image. The semiconductor unit 18 prevents the formation of such undesirable interfering voltages and provides an additional leak. The polarity of the diode depends upon the polarity of the counter-charge produced.

The leakage resistor described in conjunction with the first and second embodiments is preferably a variable resistor which may be adjusted to the most favorable leakage resistance for the specific operating conditions in each instance.

While in accordance with the provisions of the Patent Statutes the preferred form and embodiments of the invention have been illustrated and described, it will be apparent to those skilled in the art that other changes and modifications may be made without deviating from the inventive concepts set forth above.

What is claimed is:

1. Apparatus for developing latent electrostatic charge images, comprising (a) image carrier means including a conductive backing layer, and a photoconductive layer for receiving a latent electrostatic charge image;

(b) magnetic developer means for depositing a developer mixture on said photoconductive layer;

(c) means establishing a potential difference between said magnetic developer means and said backing layer, including (1) a first voltage source connected with said magnetic developer means; and (2) voltage breakdown prevention means including a high-ohmic resistor connecting said backing layer with ground;

(d) charge corona means arranged adjacent said image carrier photoconductive layer;

(e) transfer corona means arranged adjacent said image carrier photoconductive layer; and (f) second and third voltage sources including first terminals of one polarity connected with said backing layer, the second terminals of opposite polarity of said second and third voltage sources being connected with said charge corona means and with said transfer corona means, respectively.

2. Apparatus as defined in claim 1, wherein said high-ohmic resistor may be adjusted between values of $1\times10^7$ and $9\times10^8$ ohms.

3. Apparatus as defined in claim 1, wherein said image carrier means comprises a planar printing plate.

4. Apparatus as defined in claim 1, wherein said image carrier means comprises a cylindrical drum, said photoconductive layer being arranged on the outer peripheral surface of said drum for receiving a developer mixture from said magnetic developer means.

5. Apparatus as defined in claim 1, wherein said voltage breakdown prevention means further includes a semiconductor unit connecting said backing layer with ground.

6. Apparatus as defined in claim 5, wherein said semiconductor unit comprises a diode.

7. Apparatus as defined in claim 6, wherein said high-ohmic resistor is variable.

8. Apparatus as defined in claim 7, wherein said high-ohmic variable resistor may be adjusted between values of $1\times10^7$ and $9\times10^8$ ohms.

* * * * *